US005285647A

United States Patent [19]

Manz et al.

[11] Patent Number: 5,285,647

[45] Date of Patent: Feb. 15, 1994

[54] REFRIGERANT HANDLING SYSTEM WITH AIR PURGE AND MULTIPLE REFRIGERANT CAPABILITIES

[75] Inventors: Kenneth W. Manz, Paulding; Sandra Snyder; Christopher M. Powers, both of Bryan, all of Ohio

[73] Assignee: SPX Corporation, Muskegon, Mich.

[21] Appl. No.: 27,425

[22] Filed: Mar. 8, 1993

[51] Int. Cl.[5] ..... F25B 43/04

[52] U.S. Cl. ..... 62/127; 62/129; 62/195

[58] Field of Search ..... 62/129, 125, 126, 127, 62/193, 475, 85, 149, 77, 292

[56] References Cited

U.S. PATENT DOCUMENTS

| | | | |
|---|---|---|---|
| 4,304,102 | 12/1981 | Gray | 62/475 X |
| 4,364,236 | 12/1982 | Manz et al. | 62/77 |
| 4,417,451 | 11/1983 | Spauschus | 62/129 |
| 4,768,347 | 9/1988 | Manz et al. | 62/149 |
| 4,805,416 | 2/1989 | Manz et al. | 62/292 |
| 4,939,905 | 7/1990 | Manz | 62/77 |
| 5,005,369 | 4/1991 | Manz | 62/195 |
| 5,063,749 | 11/1991 | Manz | 62/149 |
| 5,127,232 | 7/1992 | Paige et al. | 62/149 X |
| 5,158,747 | 10/1992 | Manz et al. | 62/127 X |
| 5,181,391 | 1/1993 | Manz | 62/129 |
| 5,209,400 | 5/1993 | Winslow et al. | 62/127 |

*Primary Examiner*—Harry B. Tanner

*Attorney, Agent, or Firm*—Barnes, Kisselle, Raisch, Choate, Whittemore & Hulbert

[57] ABSTRACT

A refrigerant handling system that includes a closed vessel for storing refrigerant and an apparatus for determining quantity of air captured within the vessel. A first sensor is operatively coupled to the vessel for providing a first electrical signal as a function of air/refrigerant vapor pressure within the vessel, and a second sensor is operatively coupled to the vessel for providing a second electrical signal as a function of air/refrigerant vapor temperature within the vessel. A microprocessor-based controller has internal memory in which electronic indicia is stored for relating saturation pressure to temperature for multiple types of refrigerant. This stored electronic indicia is employed in conjunction with the first and second sensor signals to determine quantity of air within the vessel as a function of a difference between pressure indicated by the first sensor signal and the saturation pressure indicia at the temperature indicated by the second sensor signal. Air is purged from the vessel, either automatically or manually, when quantity of air so indicated exceeds a predetermined threshold.

20 Claims, 4 Drawing Sheets

REFRIGERANT HANDLING SYSTEM WITH AIR PURGE AND MULTIPLE REFRIGERANT CAPABILITIES

The present invention is directed to refrigerant handling systems, and more particularly to a device for purging air from within a liquid refrigerant storage vessel or container.

BACKGROUND AND OBJECTS OF THE INVENTION

U.S. Pat. No. 5,005,369, assigned to the assignee hereof, discloses a refrigerant handling system, specifically a refrigerant recovery and purification system, that includes a compressor having an inlet coupled through an evaporator and a solenoid valve to the refrigeration equipment from which refrigerant is to be recovered, and an outlet coupled through a condenser to a refrigerant storage vessel or container. Refrigerant may be withdrawn from the storage container and pumped, either by the compressor or by a separate liquid refrigerant pump, through a filter/drier for removing water and other contaminants, and then returned to the storage container. A pressure differential valve receives a first pressure input from a refrigerant bulb positioned for heat exchange with refrigerant fed to the storage container, and thus indicative of temperature of refrigerant within the container itself. A second input to the valve is indicative of air/refrigerant vapor pressure within the container. The valve is coupled to a purge port on the container for automatically venting air from within the container when the pressure differential between the valve input ports exceeds the threshold setting of the valve. In a modified embodiment, a differential pressure gauge receives the first pressure input indicative of refrigerant temperature ana the second input indicative of air/refrigerant vapor pressure within the container, and a manual valve is coupled to the container purge port for manipulation by an operator when the gauge indicates excessive pressure differential.

U.S. Pat. No. 5,063,749, also assigned to the assignee hereof, discloses a refrigerant handling system having both air purge and multiple refrigerant capabilities. A refrigerant bulb is positioned for heat exchange with refrigerant fed to the storage container as in the earlier patent. A double-needle pressure gauge has a first port coupled to the refrigerant bulb and a second port coupled to the container. The gauge needles thereby indicate vapor pressure of refrigerant fed to the container and refrigerant/air vapor pressure within the container. The gauge is provided with multiple scales calibrated for different types of refrigerant, so that an operator knowing the type of refrigerant under service may observe the gauge, determine the pressure differential between the container refrigerant/air vapor pressure and the saturation pressure for that refrigerant, and manually purge air from within the container when such pressure differential exceeds the desired level.

U.S. Pat. No. 5,181,391, also assigned to the assignee hereof, discloses a refrigerant handling system having both air purge and multiple refrigerant capabilities. A bulb containing a reference refrigerant is positioned in heat transfer relation with refrigerant fed to the storage container, as in the earlier patents. A pressure gauge is coupled to the bulb and calibrated to indicate saturation temperature of the reference refrigerant, and thereby reflect actual temperature of refrigerant in the container. A differential pressure gauge has separate scales for multiple refrigerant types (e.g., R22, R134a, R500, R502) to indicate apparent refrigerant temperature as a function of any bulb/container pressure differential. Any difference between these temperature readings is considered to reflect partial pressure of air within the container, which may be purged through a valve coupled to the container.

Although the systems disclosed in the above-noted patents and application address and overcome problems theretofore extant in the art, further improvements remain desirable. For example, although the automatic and manual air purge techniques disclosed in U.S. Pat. No. 5,005,369 operate well for a specific type of refrigerant, this technique is not well suited for use in conjunction with multiple refrigerants because the air/refrigerant vapor pressure in the storage container does not compare with the saturation pressure within the bulb properly to indicate partial pressure of air within the container unless the refrigerant in the bulb is of the same type as that in the container. The systems of U.S. Pat. No. 5,063,749 and application Ser. No. 07/844,559, U.S. Pat. No. 5,181,391, provide such multiple refrigerant capability, but have the disadvantage that comparison of two needle readings is required.

It is therefore a general object of the present invention to provide a refrigerant handling system with air purge capability that is accurate and adapted for both automatic and manual operation, that i s capable of handling multiple differing types of refrigerants, and/or that can assist an operator in identifying and/or confirming the type of refrigerant in the handling system and indicating potential mixing of refrigerants.

SUMMARY OF THE INVENTION

In a refrigerant handling system that includes a closed vessel for storing refrigerant, the present invention provides apparatus for determining quantity of air captured within the vessel with the refrigerant. A first sensor is operatively coupled to the vessel for providing a first electrical signal as a function of air/refrigerant vapor pressure within the vessel, and a second sensor is operatively coupled to the vessel for providing a second electrical signal as a function of air/refrigerant vapor temperature within the vessel. A microprocessor-based controller has internal memory in which electronic indicia, such as a equations or look-up table data, is stored for relating saturation pressure to temperature for at least one type of refrigerant, and preferably multiple types of refrigerants. This stored electronic indicia is employed in conjunction with the first and second sensor signals to determine quantity of air within the vessel as a function of a difference between pressure indicated by the first sensor signal and the electronic saturation pressure indicia at the temperature indicated by the second sensor signal. Thus, air may be purged from the vessel, either automatically or manually, when quantity of air so indicated exceeds a predetermined threshold.

In the preferred embodiments of the invention in which the microprocessor-based controller is programmed with saturation pressure/temperature indicia for multiple types of refrigerants, the apparatus of the invention also includes facility for indicating apparent type of refrigerant within the vessel. In various embodiments of the invention, this may take the form of an operator input such as a keypad for providing an electrical signal to the controller indicative of the type of refrigerant that the operator believes to be in the vessel. Alternatively, the controller itself may determine apparent type of refrigerant from the pressure and temperature sensor signals as a function of the prestored indicia for each refrigerant type that most closely matches the sensor signals. For example, where the prestored indicia comprises a look-up table having saturation pressure/-temperature curves stored therein for several refrigerant types, the controller may indicate apparent refrigerant type as a function of the curve that most closely matches the pressure and temperature sensor readings. In a third embodiment of the invention, separate test apparatus such as that disclosed in U.S. Pat. No. 5,158,747, assigned to the assignee hereof, is coupled to the refrigerant handling system for determining refrigerant type as a function of one or more properties of the refrigerant, and providing a corresponding signal to the controller.

Where the apparatus includes facility for operator input of refrigerant type, the temperature and pressure sensor readings may be employed by the controller in conjunction with the prestored indicia for confirming such refrigerant type, or for indicating to the operator that such apparent refrigerant type is not correct, or that refrigerants have apparently been mixed, when the temperature and pressure sensor readings do not correlate with the type of refrigerant input by the operator. Quantity of air within the refrigerant vessel is indicated in the preferred embodiments of the invention by an operator display. In two preferred embodiments of the invention, the display comprises an alphanumeric display or a graphic display.

Air may be purged from the refrigerant holding vessel by a manual purge valve, or by a solenoid valve automatically responsive to the controller. The refrigerant vessel in the preferred embodiments of the invention comprises a refrigerant storage container having multiple ports for access to the container interior. The temperature and/or pressure sensor may be disposed in a connector adapted for releasable coupling to a container port that opens into the upper portion of the container—i.e., the container headspace in which the air/refrigerant vapor is disposed. Alternatively, one or both of the pressure and temperature sensors may be coupled to refrigerant conduits for feeding refrigerant to or from the container.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
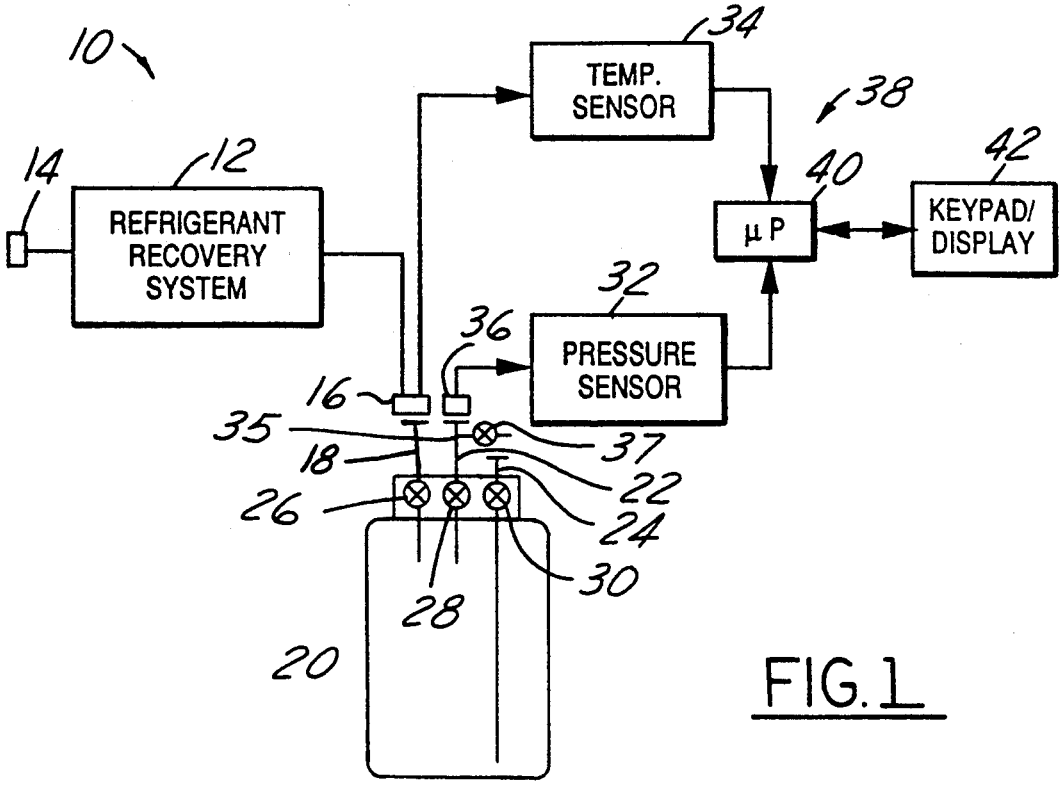
FIG. 1 is a schematic diagram that illustrates a refrigerant recovery system in conjunction with apparatus in accordance with a presently preferred embodiment of the invention.

FIG. 1 illustrates a refrigerant handling system 10 in accordance with one presently preferred embodiment of the invention as comprising a refrigerant recovery system 12 having an input 14 for connection to refrigeration equipment, such as air conditioning or heat pump equipment, from which refrigerant is to be recovered. The outlet of refrigerant recovery system 12 has a connector 16 for releasable coupling to the vapor port 18 of a refrigerant storage vessel or container 20. Vessel 20 also has a purge port 22 and a liquid port 24, with each of the ports 20–24 having associated therewith a corresponding manual valve 26,28,30. To the extent thus far described, refrigerant handling system 10 is of generally conventional type, as shown for example in U.S. Pat. No. 4,768,347 assigned to the assignee hereof.

In accordance with the present invention, a pressure sensor 32 and a temperature sensor 34 are operatively coupled to refrigerant storage container 20 so as to indicate pressure and temperature respectively of the air/refrigerant vapor in the headspace of container 20 over any liquid refrigerant stored therein. In the embodiment of FIG. 1, temperature sensor 34 is positioned within connector 16 coupled to vapor port 18, while pressure sensor 32 is positioned within a separate connector 36 for releasable connection to a tee coupling 35 on purge port 22. A manual valve 37 is fastened to the other branch of tee 35. With valves 26,28 open, both sensors 32,34 are thereby connected and directly responsive to pressure and temperature of the air/refrigerant vapor within the container headspace. Pressure sensor 32 thus indicates actual air/refrigerant vapor pressure within the container, and temperature sensor 34 indicates actual air/refrigerant vapor temperature within the container.

Figure 7:
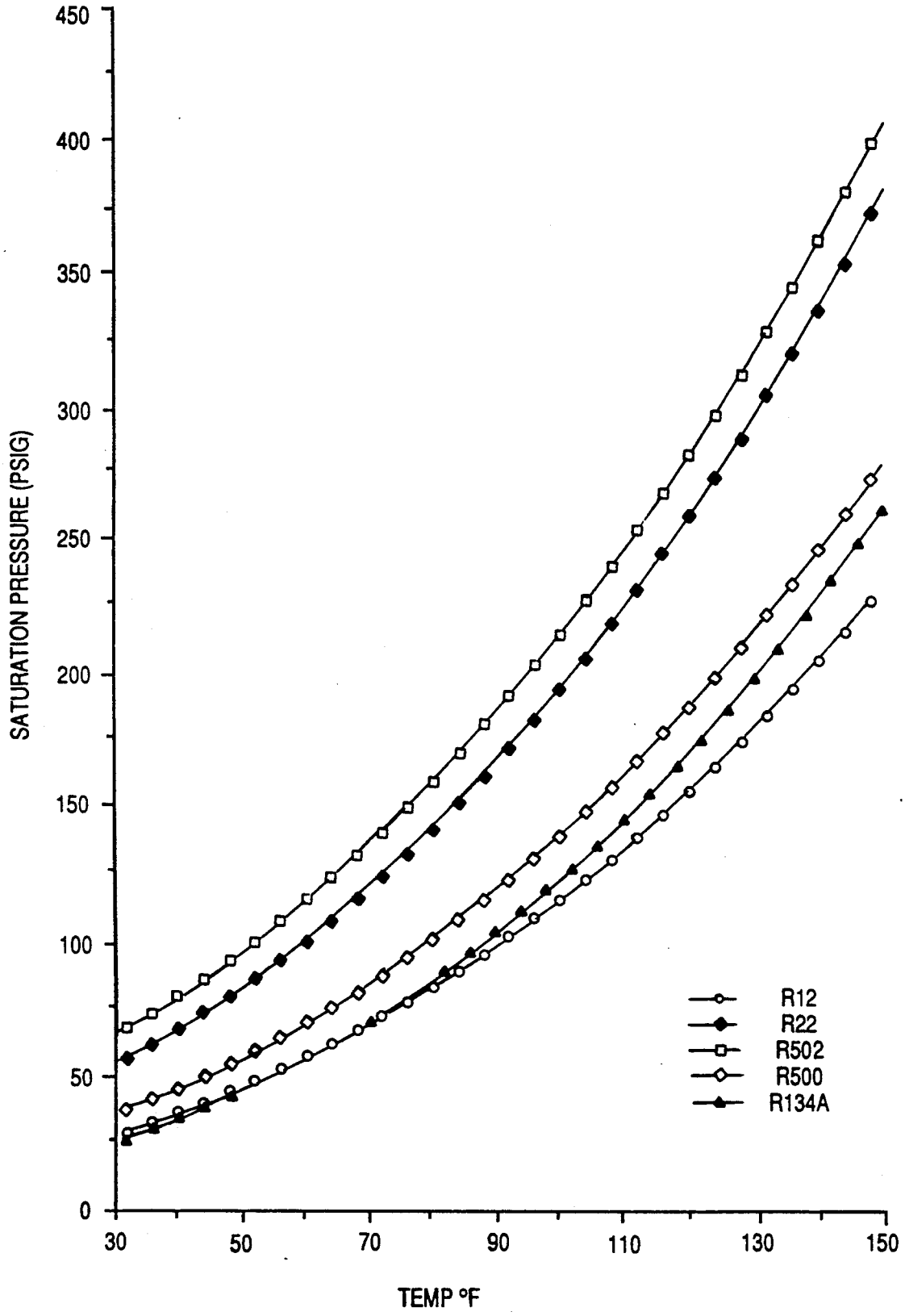
FIG. 7 is a graph that illustrates refrigerant saturation pressure versus temperature f or multiple differing refrigerant types.

Each sensor 32,34 provides an electrical signal to a controller 38 that includes a microprocessor 40 and an operator keypad/display 42. Microprocessor 40 has prestored therein electronic indicia graphically illustrated in FIG. 7 for relating saturation pressure in psig to temperature in OF for multiple differing types of refrigerant—e.g. , R12, R22, R502, R500 and R134a. Such indicia may be stored in the form of equations or, more preferably, in the form of look-up tables for the various refrigerants. Keypad/display 42 is illustrated in greater detail in FIG. 5. A keypad 44 has keys appropriately labeled for each type of refrigerant, and is connected to microprocessor 50 (FIG. 1) such that operator depression of a key in pad 44 provides an electrical signal to the microprocessor indicating that the operator believes the corresponding refrigerant to be contained within vessel 20. The keys of pad 44 include illumination facility, so that the key depressed by the operator is illuminated to confirm the type of refrigerant selected. A bar chart-type graphic display 46 extends horizontally along keypad/display 42, and contains separate display segments 48 that cooperate with adjacent printed indicia on the display panel for indicating percent air within container 20. In the particular embodiment illustrated in FIG. 5, percent air is displayed in the range of $-1\%$ to $+5.5\%$, with additional display segments at either end of the display scale for indicating that the percent air is beyond this range.

Figure 5:
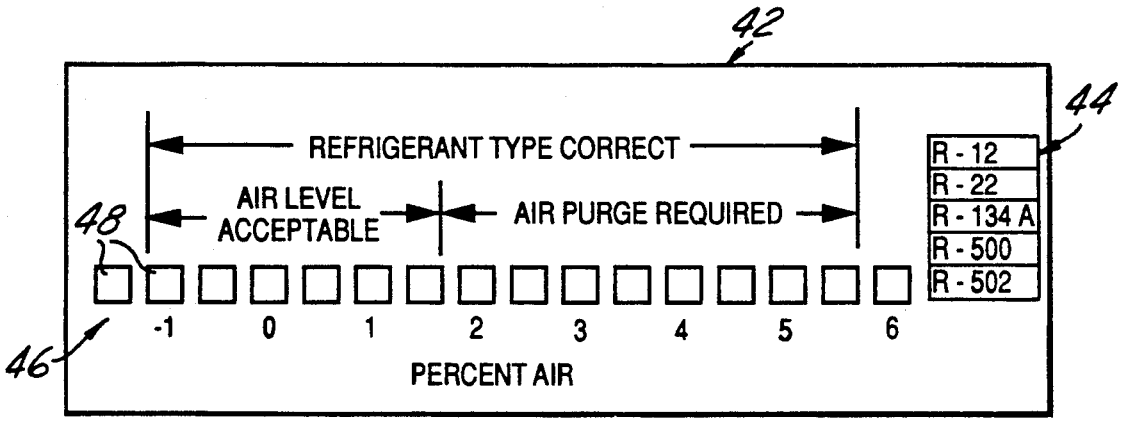
FIGS. 5 and 6 are schematic diagrams that illustrate two operator displays in accordance with the preferred embodiments of the invention.

In operation, connectors 16,36 are coupled to ports 18,22 as illustrated in FIG. 1, and valves 26,28 are opened. The particular type of refrigerant within container 20 is input by the operator through keypad 44. Employing the corresponding internal look-up table graphically illustrated in FIG. 7, microprocessor 40 then converts the temperature reading of sensor 34 to a corresponding saturation pressure reading for the particular type of refrigerant involved, and compares that saturation pressure reading with the actual air/refrigerant vapor pressure reading from pressure sensor 32. Percent air is calculated as equal to 100(Pt-Pb)/Pb, where Pt is tank pressure indicated by sensor 32 and Pb is saturation pressure per the look-up table of FIG. 7. The percent air determination is normally a positive number since tank pressure is normally greater than saturation pressure. ARI Standard 700-88 establishes 1.5% air as an acceptable amount. In FIG. 5, an acceptable range is illustrated as extending from −1% to +1.5%, with the −1% level being allowable to accommodate measurement error or a small amount of refrigerant mixing. In the range of 2% through 5.5%, display 46 indicates that "air purge [is] required." Since quantities of air outside the range of −1% to +5.5% would most likely indicate that the wrong refrigerant type has been selected, or that unacceptable refrigerant mixing has occurred, this range is labeled "refrigerant type correct" and an indication outside of this range would indicate probable error. Air is purged by opening valve 37.

Figure 2:
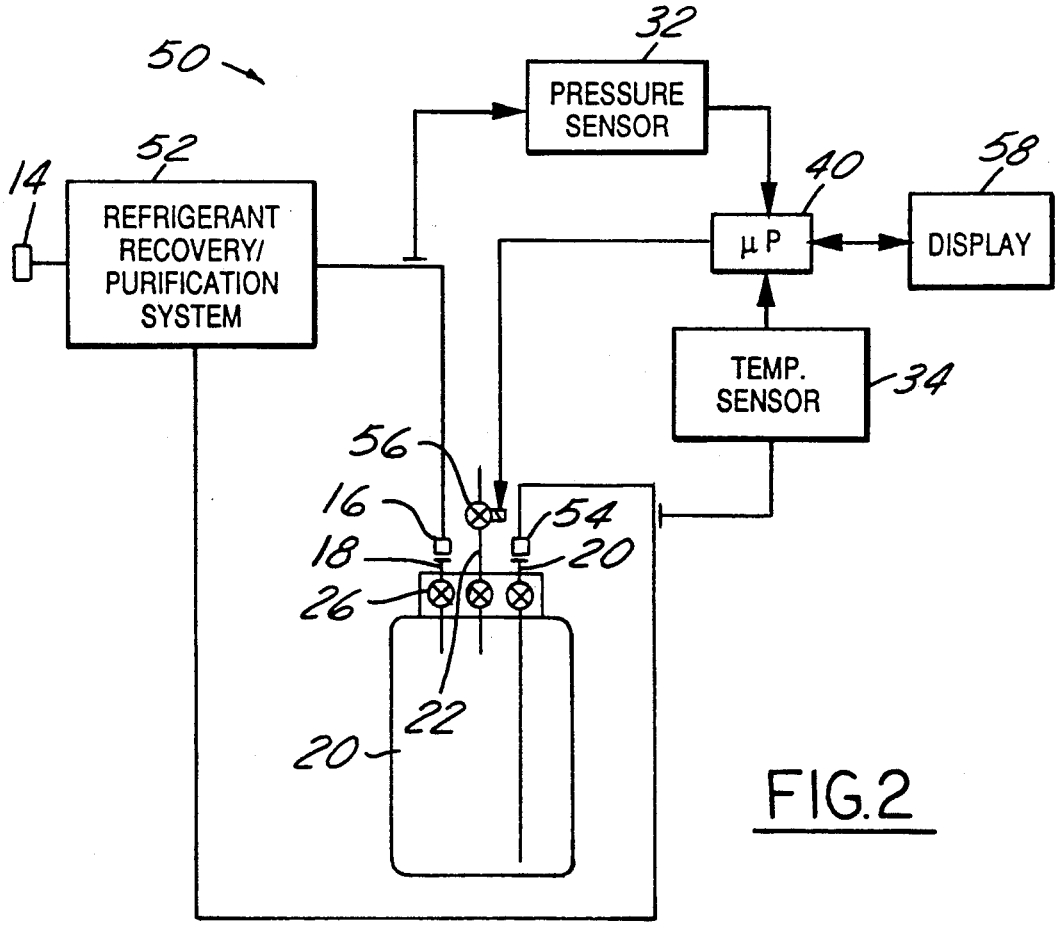
FIG. 2 is a schematic diagram that illustrates apparatus in accordance with the invention in conjunction with a refrigerant recovery/purification system.

FIG. 2 illustrates a refrigerant handling system 50 that includes a refrigerant recovery/purification system 52 having input 14 for connection to refrigeration equipment under service, output 16 for connection to vapor port 18 of container 20, and a purification input connected to a coupling 54 for releasable connection to liquid port 24 of container 20. To the extent thus far described, refrigerant handling system 50 is of the type illustrated in U.S. Pat. No. 4,805,416 assigned to the assignee hereof, with the supplemental refrigerant input connected to container liquid port 20 providing for recirculation of refrigerant from container 20 through system 52 and then back to the container in one or multiple passes as required for removal of water and other contaminants from the refrigerant.

In this embodiment of the invention, pressure sensor 32 is operatively coupled to the refrigerant conduit that connects system 52 to connector 16 so that, with valve 26 open, pressure sensor indicates actual headspace air/refrigerant vapor pressure within the container. Temperature sensor 34 is operatively coupled in this embodiment to the refrigerant conduit that connects coupling 54 to the supplemental system input so that, when refrigerant is being circulated in a purification mode of operation, sensor 34 provides a signal representative of temperature of the air/refrigerant vapor within the container headspace. A solenoid valve 56 is connected to container purge port 22, and is responsive to control signals from microprocessor 40 for automatically purging air from within container 20 when percent air within the container is between 1.5% and 5.5%.

Figure 6:
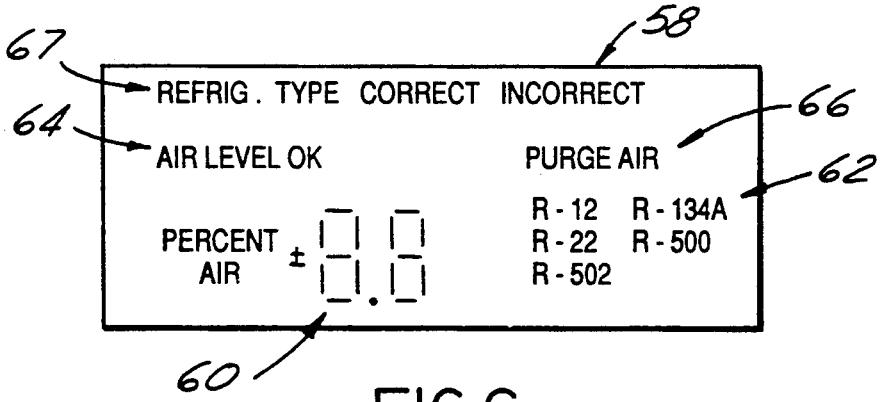

In the embodiment of FIG. 2, microprocessor 40 is coupled to an operator display 58 (FIGS. 2 and 6), which preferably comprises a liquid crystal display (LCD) with a 7-segment section 60 for numeric display of calculated percent air. In this embodiment, there is no operator input of refrigerant type. Rather, microprocessor 40 determines apparent refrigerant type based upon pressure and temperature signals f rom sensors 32,34. In particular, microprocessor 40 first obtains a temperature reading from sensor 34, and then calculates percent air as described above based upon the lowest prestored pressure/temperature saturation curve indicia—i.e., R12 in FIG. 7. If the percent air so calculated is negative, the microprocessor then recalculates percent air based upon the same temperature reading but employing the next higher curves (i.e., R134a, R500, R22 and R502 in sequence in FIG. 7) until a refrigerant is found that yields a positive number for percent air. The microprocessor then compares the percent air so calculated from this curve and the calculation immediately preceding for the next lower curve to the expected range of −1% to +5.5%, and displays the apparent refrigerant type at segment 62 (FIG. 6) of LCD 58. The microprocessor also activates either display segment 64 indicating that percent air is within the acceptable range of −1% to +1.5% (in the examples herein discussed), or display segment 66 to indicate that air purge is required. A display field 67 may indicate that refrigerant type is correct or incorrect when a separate operator refrigerant input device is employed.

Figure 3:
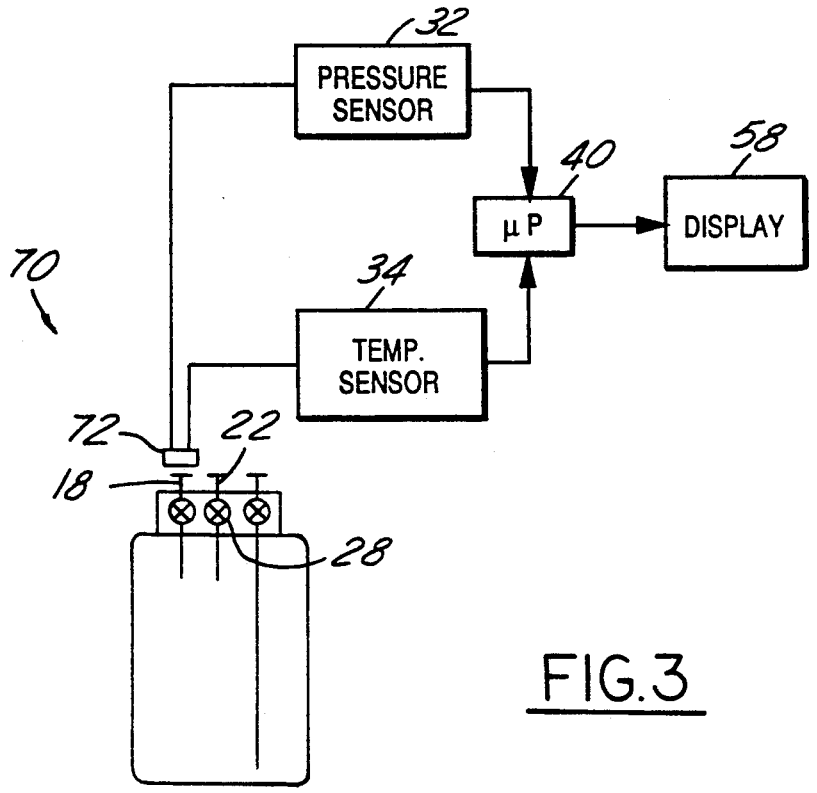
FIG. 3 is a schematic diagram that illustrates apparatus in accordance with the invention employed in conjunction with a refrigerant storage container alone.

FIG. 3 illustrates a refrigerant handling system 70 in which the apparatus of the invention may be employed for determining refrigerant type and/or purging air from within a refrigerant storage vessel or container 20 separate and apart from a refrigerant recovery or refrigerant recovery/purification system (FIGS. 1 and 2). In this embodiment, both pressure sensor 32 and temperature sensor 34 are disposed within a connector 72 for coupling to the vapor port 18 of container 20. Sensors 32,34 thereby obtain direct readings of actual temperature and pressure of the air/refrigerant vapor within the container headspace, and provide corresponding sensor signals to microprocessor 40. Microprocessor 40 cooperates with display 58 (or display 42 in FIG. 1) as hereinabove described to indicate refrigerant type and/or a need to purge air from container 20, the latter being accomplished by operator manipulation of manual valve 28 at container purge port 22.

Figure 4:
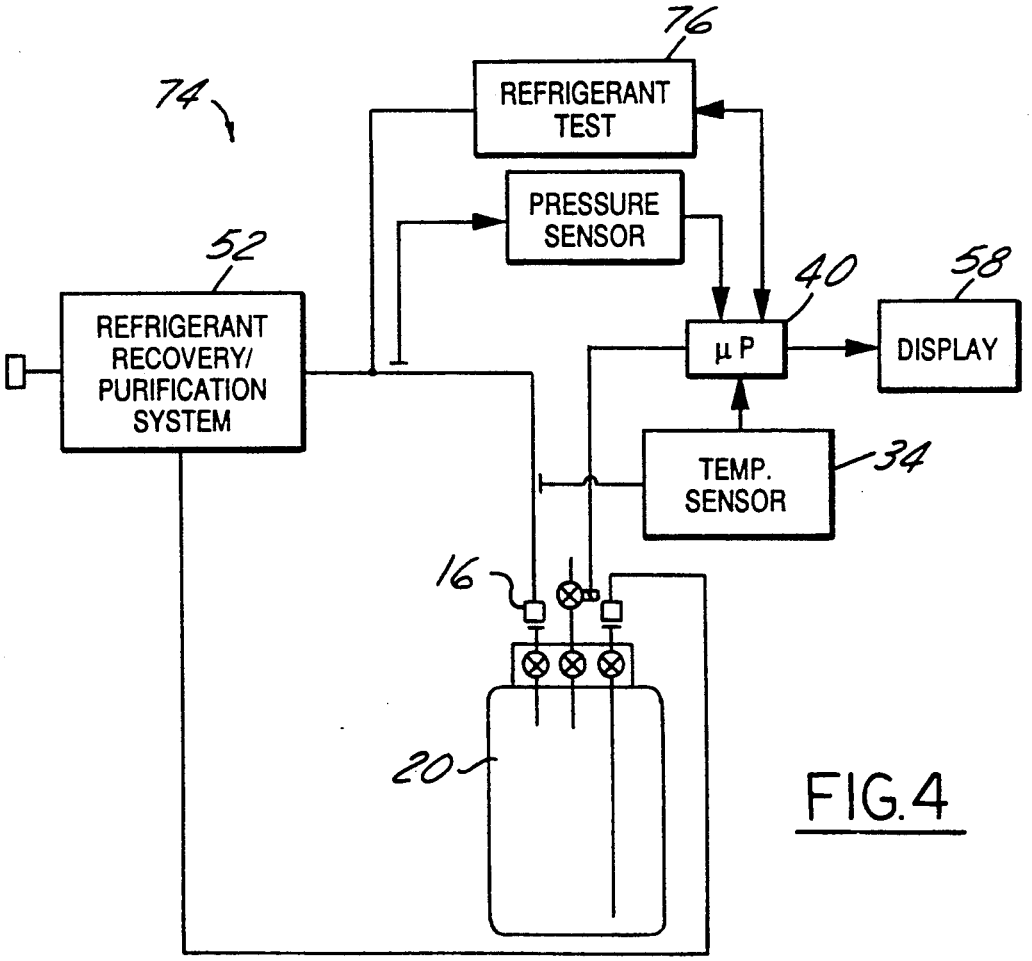
FIG. 4 is a schematic diagram that illustrates a further embodiment of the invention.

FIG. 4 illustrates a refrigerant handling system 74 that is similar in many respects to system 50 (FIG. 2) with two exceptions. First, temperature sensor 34 is operatively coupled to container 20 by heat conductive coupling to refrigerant being fed to container 20 between refrigerant recovery/purification system 52 and connector 16. In this way, temperature sensor 34 obtains a reading indicative of apparent temperature of the air/refrigerant vat)or within the container headspace as a function of the temperature of refrigerant being fed to the container, as distinguished from temperature of refrigerant being withdrawn from the container in FIG. 2. (It will be appreciated, of course, that temperature sensor 34 may be positioned in connector 16 in either FIG. 2 or 4 to obtain a direct air/refrigerant vapor temperature reading, as in FIGS. 1 and 3. ) Second, refrigerant type is determined in the embodiment of FIG. 4 employing a refrigerant test apparatus 76, coupled to microprocessor 40, for determining refrigerant type as a function of one or more physical properties of the refrigerant. Apparatus 76 may be of the type disclosed in U.S. Pat. No. 5,158,747, the disclosure of which is incorporated herein by reference. Thus, refrigerant type is determined directly in the embodiment of FIG. 4, as distinguished from being imputed or estimated as in the embodiment of FIG. 2.

It will be appreciated from the foregoing description that the basic principles of the present invention are amenable to many modifications and variations. In each of the embodiments herein disclosed, actual pressure of air/refrigerant vapor within the container is determined by placement of the pressure sensor either at a port or aperture of the container (FIGS. 1 and 3) or at a conduit that feeds refrigerant to the container closely adjacent to the container (FIGS. 2 and 4). Temperature of the air/refrigerant vapor within the container may be determined either directly by placement of the temperature sensor at a suitable container aperture or port (FIGS. 1 and 3), or indirectly by measuring a representative temperature of refrigerant fed to (FIG. 4) or from (FIG. 2) the container. Microprocessor 40 may be programmed with equations or tables that relate saturation pressure to temperature for determining percent air within the container headspace. The microprocessor is also adapted to determine or confirm type of refrigerant, or to indicate that unacceptable refrigerant mixing has occurred.

In the preferred embodiments herein disclosed, the invention is employed in conjunction with standard DOT-approved replaceable refrigerant storage containers having separate valved vapor, liquid and purge ports as illustrated. However, the invention in its broadest aspects may be employed in conjunction with other types of refrigerant vessels, such as fixed holding reservoirs or vessels that form part of the refrigerant recovery or recovery/purification equipment itself. Such a system is shown, for example, in U.S. Pat. No. 4,364,236, assigned to the assignee hereof. Acceptable and unacceptable air quantities discussed hereinabove relate to current ARI standards as noted, and do not per se form part of the present invention. The specific types of refrigerants herein discussed are by way of example only.

We claim:

1. In a refrigerant handling system that includes a closed vessel for storing refrigerant, apparatus for determining quantity of air captured within said vessel with the refrigerant comprising:

first sensing means operatively coupled to said vessel for providing a first electrical signal as a function of air/refrigerant vapor pressure within said vessel, second sensing means operatively coupled to said vessel for providing a second electrical signal as a function of air/refrigerant vapor temperature within said vessel, and microprocessor-based control means having stored therein electronic indicia that relates saturation pressure to temperature for at least one type of refrigerant, and means for receiving said first and second signals and responsive to said indicia for indicating quantity of air within said vessel as a function of a difference between pressure indicated by said first signal and said saturation pressure indicia at the temperature indicated by said second signal.

2. The apparatus set forth in claim 1 wherein said microprocessor-based control means has stored therein electronic indicia that relates saturation pressure to temperature for a plurality of refrigerant types, and wherein said apparatus further comprises means for indicating to said control means apparent type of refrigerant within said vessel.

3. The apparatus set forth in claim 2 wherein said means for indicating apparent refrigerant type comprises means responsive to an operator for providing an electrical signal to said control means indicative of said apparent refrigerant type.

4. The apparatus set forth in claim 2 wherein said means for indicating apparent refrigerant type comprises means within said control means responsive to said first and second signals for indicating said apparent refrigerant type as a function of said indicia.

5. The apparatus set forth in claim 2 wherein said means for indicating apparent refrigerant type comprises means operatively coupled to said vessel and responsive at least one property of refrigerant within said vessel for determining refrigerant type.

6. The apparatus set forth in claim 2 wherein said microprocessor-based control means further includes means responsive to said first and second signals and to said indication of apparent refrigerant type for indicating either incorrect refrigerant type or mixed refrigerant types as a function of said indicia.

7. The apparatus set forth in claim 1 further comprising means responsive to said control means for indicating a need to purge air from said vessel when said air quantity exceeds a preselected level.

8. The apparatus set forth in claim 1 further comprising means for purging air from within said vessel.

9. The apparatus set forth in claim 8 wherein said purging means comprising a manual valve coupled to said vessel.

10. The apparatus set forth in claim 8 wherein said purging means comprises a solenoid valve operatively coupled and responsive to said control means for automatically purging air from said vessel when said air quantity within said vessel exceeds a preselected level.

11. The apparatus set forth in claim 1 wherein said vessel comprises a refrigerant storage container having multiple ports for access to said container.

12. The apparatus set forth in claim 11 wherein at least one of said first and second sensing means is disposed in a connector adapted for releasable coupling to at least one port that opens to an upper portion of the container.

13. The apparatus set forth in claim 12 wherein said first and second sensing means are disposed in the same said connector.

14. The apparatus set forth in claim 12 wherein said first and second sensing means are disposed in separate said connectors.

15. The apparatus set forth in claim 1 wherein said system includes refrigerant conduit means for passage of refrigerant to and/or from said vessel, and wherein at least one of said first and second sensing means is coupled to said refrigerant conduit means.

16. The apparatus set forth in claim 1 wherein said means for indicating air quantity includes means for displaying air quantity to an operator.

17. The apparatus set forth in claim 16 wherein said displaying means includes means for disclaying air quantity as a function of percent of total air/refrigerant vapor within said vessel.

18. The apparatus set forth in claim 17 wherein said displaying means comprises an alphanumeric display.

19. The apparatus set forth in claim 17 wherein said displaying means comprises a graphic display.

20. The apparatus set forth in claim 17 wherein said displaying means further includes means responsive to said control means for displaying apparent type of refrigerant within said vessel.

* * * * *

US005285647B1

REEXAMINATION CERTIFICATE (3737th)

United States Patent [19] [11] B1 5,285,647

Manz et al. [45] Certificate Issued Feb. 23, 1999

[54] REFRIGERANT HANDLING SYSTEM WITH AIR PURGE AND MULTIPLE REFRIGERANT CAPABILITIES

[75] Inventors: Kenneth W. Manz, Paulding; Sandra Snyder; Christopher M. Powers, both of Bryan, all of Ohio

[73] Assignee: SPX Corporation, Muskegeon, Mich.

Reexamination Request:
No. 90/004,082, Dec. 21, 1995

Reexamination Certificate for:

| | |
|---|---|
| Patent No.: | **5,285,647** |
| Issued: | **Feb. 15, 1994** |
| Appl. No.: | **27,425** |
| Filed: | **Mar. 8, 1993** |

[51] Int. Cl.[6] ..... F25B 43/04
[52] U.S. Cl. ..... 62/127; 62/129; 62/195
[58] Field of Search ..... 62/85, 77, 125, 62/126, 127, 129, 149, 195, 292, 475

[56] References Cited

U.S. PATENT DOCUMENTS

| | | | |
|---|---|---|---|
| 2,475,218 | 7/1949 | Campbell | 62/475 X |
| 3,234,748 | 2/1966 | Quick | 62/126 |
| 4,285,206 | 8/1981 | Koser | 62/126 |
| 4,304,102 | 12/1981 | Gray | 62/475 X |
| 4,364,236 | 12/1982 | Manz et al. | 62/77 |
| 4,417,451 | 11/1983 | Spauschus | 62/129 |
| 4,445,366 | 5/1984 | Gray | 73/64.2 |
| 4,768,347 | 9/1988 | Manz et al. | 62/149 |
| 4,805,416 | 2/1989 | Manz et al. | 62/292 |
| 4,939,905 | 7/1990 | Manz | 62/77 |
| 4,967,567 | 11/1990 | Proctor et al. | 62/127 |
| 5,005,369 | 4/1991 | Manz | 62/195 |
| 5,063,749 | 11/1991 | Manz | 62/149 |
| 5,078,756 | 1/1992 | Major et al. | 55/21 |
| 5,127,232 | 7/1992 | Paige et al. | 62/149 X |
| 5,158,747 | 10/1992 | Manz et al. | 422/98 |
| 5,181,391 | 1/1993 | Manz | 62/129 |
| 5,189,889 | 3/1993 | Daily | 62/292 |
| 5,209,400 | 5/1993 | Winslow et al. | 236/94 |

*Primary Examiner*—Harry Tanner

[57] ABSTRACT

A refrigerant handling system that includes a closed vessel for storing refrigerant and an apparatus for determining quantity of air captured within the vessel. A first sensor is operatively coupled to the vessel for providing a first electrical signal as a function of air/refrigerant vapor pressure within the vessel, and a second sensor is operatively coupled to the vessel for providing a second electrical signal as a function of air/refrigerant vapor temperature within the vessel. A microprocessor-based controller has internal memory in which electronic indicia is stored for relating saturation pressure to temperature for multiple types of refrigerant. This stored electronic indicia is employed in conjunction with the first and second sensor signals to determine quantity of air within the vessel as a function of a difference between pressure indicated by the first sensor signal and the saturation pressure indicia at the temperature indicated by the second sensor signal. Air is purged from the vessel, either automatically or manually, when quantity of air so indicated exceeds a predetermined threshold.

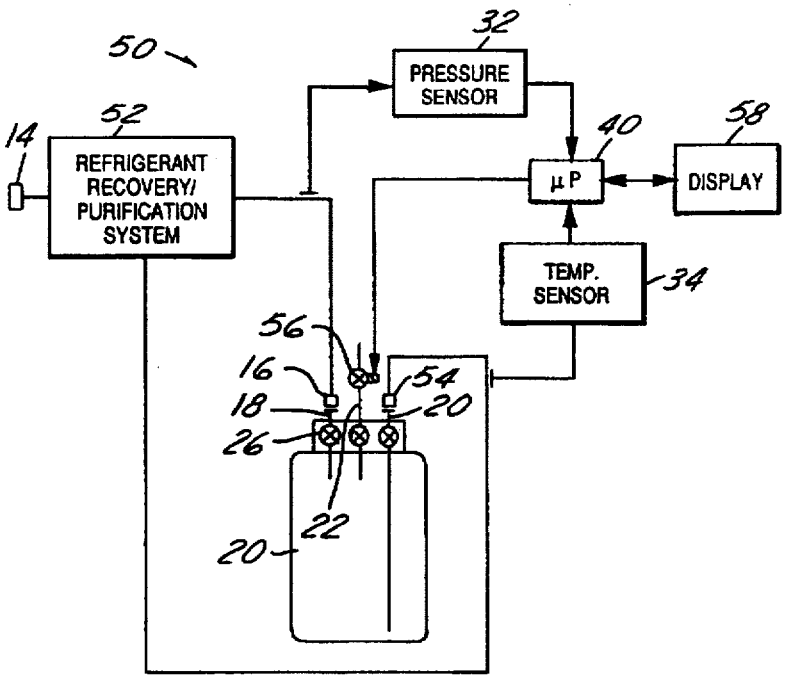

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–3, 7–8, 11 and 15–17 are determined to be patentable as amended.

Claims 4–6, 9–10, 12–14 and 18–20, dependent on an amended claim, are determined to be patentable.

New claims 21–26 are added and determined to be patentable.

1. In a refrigerant handling system that includes a closed vessel for storing refrigerant, apparatus for determining quantity of air captured within said vessel with the refrigerant comprising:

first sensing means operatively coupled to said vessel for providing a first electrical signal as a function of air/refrigerant vapor pressure within said vessel, second sensing means operatively coupled to said vessel for providing a second electrical signal as a function of air/refrigerant vapor temperature within said vessel, and microprocessor-based control means having stored therein electronic indicia that relates saturation pressure to temperature for at least one type of refrigerant, and means for receiving said first and second signals and responsive to said indicia for indicating quantity of air within said vessel as a function of a difference between pressure indicated by said first signal and said saturation pressure indicia at the temperature indicated by said second signal,

*said means for indicating air quantity including means for automatically determining quantity of air within the vessel from said first and second signals and displaying said air quantity to an operator.*

2. The apparatus set forth in claim 1 *or 22* wherein said microprocessor-based control means has stored therein electronic indicia that relates saturation pressure to temperature for a plurality of refrigerant types, and wherein said apparatus further comprises means for indicating to said control means apparent type of refrigerant within said vessel.

3. The apparatus set forth in claim 2 wherein said means for indicating apparent refrigerant type *to said control means* comprises means responsive to an operator for providing [an] *a third* electrical signal to said control means indicative of said apparent refrigerant type, *said control means comprising means responsive to said third signal for selecting, from among said plurality of indicia, electronic indicia associated with the refrigerant type indicated by said third signal.*

7. The apparatus set forth in claim 1, *21, 22 or 26* further comprising means responsive to said control means for indicating a need to purge air from said vessel when said air quantity exceeds a preselected level.

8. The apparatus set forth in claim 1, *21, 22 or 26* further comprising means for purging air from within said vessel.

11. The apparatus set forth in claim 1, *21, 22 or 26* wherein said vessel comprises a refrigerant storage container having multiple ports for access to said container.

15. The apparatus set forth in claim 1, *21, 22 or 26* wherein said system includes refrigerant conduit means for passage of refrigerant to and/or from said vessel, and wherein at least one of said first and second sensing means is coupled to said refrigerant conduit means.

16. The apparatus set forth in claim [1] *21* wherein said means for indicating air quantity includes means for displaying air quantity to an operator.

17. The apparatus set forth in claim *1 or* 16 wherein said displaying means includes means for displaying air quantity as a function of percent of total air/refrigerant vapor within said vessel.

*21. In a refrigerant handling system that includes a closed vessel for storing refrigerant, apparatus for determining quantity of air captured within said vessel with the refrigerant comprising:*

*first sensing means operatively coupled to said vessel for providing a first electrical signal as a function of air/refrigerant vapor pressure within said vessel,*

*second sensing means operatively coupled to said vessel for providing a second electrical signal as a function of air/refrigerant vapor temperature within said vessel, and*

*microprocessor-based control means having prestored therein electronic indicia including a look-up table that relates refrigerant saturation pressure to temperature for at least one type of refrigerant, means for receiving said first and second signals, means responsive to said second signal for obtaining from said look-up table indicia a corresponding refrigerant saturation pressure value, means responsive to said first signal for comparing said corresponding refrigerant saturation pressure value to said first signal indicative of air/refrigerant vapor pressure within the vessel, and means for indicating quantity of air within the vessel as a function of a difference between air/refrigerant vapor pressure indicated by said first signal and said corresponding refrigerant saturation pressure value obtained from said look-up table indicia at the temperature indicated by said second signal,*

*said microprocessor-based control means having stored therein electronic indicia that relates saturation pressure to temperature for a plurality of refrigerant types,*

*said apparatus further comprising means for indicating to said control means apparent type of refrigerant within said vessel comprising means responsive to an operator for providing a third electrical signal to said control means indicative of said apparent refrigerant type, said control means comprising means responsive to said third signal for selecting, from among said plurality of indicia, electronic indicia associated with the refrigerant type indicated by said third signal.*

*22. In a refrigerant handling system that includes a closed vessel for storing refrigerant, apparatus for determining quantity of air captured within said vessel with the refrigerant comprising:*

*first sensing means operatively coupled to said vessel for providing a first electrical signal as a function of air/refrigerant vapor pressure within said vessel,*

*second sensing means operatively coupled to said vessel for providing a second electrical signal as a function of air/refrigerant vapor temperature within said vessel, and*

*microprocessor-based control means having stored therein electronic indicia that relates saturation pressure to temperature for at least one type of refrigerant, and means for receiving said first and second signals and responsive to said indicia for indicating quantity of air within said vessel as a function of a difference between pressure indicated by said first signal and said saturation pressure indicia at the temperature indicated by said second signal,*

*said means for indicating air quantity including means for displaying air quantity to an operator as a function of percent of total air/refrigerant vapor within said vessel.*

*23. The apparatus set forth in claim 22 wherein said displaying means comprises an alphanumeric display.*

*24. The apparatus set forth in claim 22 wherein said displaying means comprises a graphic display.*

*25. The apparatus set forth in claim 22 wherein said displaying means further includes means responsive to said control means for displaying apparent type of refrigerant within said vessel.*

*26. In a refrigerant handling system that includes a closed vessel for storing refrigerant, apparatus for determining quantity of air captured within said vessel with the refrigerant comprising:*

*first sensing means operatively coupled to said vessel for providing a first electrical signal as a function of air/refrigerant vapor pressure within said vessel,*

*second sensing means operatively coupled to said vessel for providing a second electrical signal as a function of air/refrigerant vapor temperature within said vessel, and*

*microprocessor-based control means having prestored therein electronic indicia including a look-up table that relates refrigerant saturation pressure to temperature for at least one type of refrigerant, means for receiving said first and second signals, means responsive to said second signal for obtaining from said look-up table indicia a corresponding refrigerant saturation pressure value, means responsive to said first signal for comparing said corresponding refrigerant saturation pressure value to said first signal indicative of air/refrigerant vapor pressure within the vessel, and means for indicating quantity of air within the vessel as a function of a difference between air/refrigerant vapor pressure indicated by said first signal and said corresponding refrigerant saturation pressure value obtained from said look-up table indicia at the temperature indicated by said second signal,*

*said microprocessor-based control means having stored therein electronic indicia that relates saturation pressure to temperature for a plurality of refrigerant types,*

*said apparatus further comprising means for indicating to said control means apparent type of refrigerant within said vessel, and*

*said microprocessor-based control means further including means responsive to said first and second signals and to said indication of apparent refrigerant type for indicating either incorrect refrigerant type or mixed refrigerant types as a function of said indicia.*

* * * * *